US008998779B1

(12) United States Patent
Ihli et al.

(10) Patent No.: US 8,998,779 B1
(45) Date of Patent: Apr. 7, 2015

(54) EXERCISE RESISTANCE APPARATUS

(71) Applicants: Stephen P. Ihli, Santa Monica, CA (US); Mark A. Krull, New Braunfels, TX (US)

(72) Inventors: Stephen P. Ihli, Santa Monica, CA (US); Mark A. Krull, New Braunfels, TX (US)

( * ) Notice: Subject to any disclaimer, the term of this patent is extended or adjusted under 35 U.S.C. 154(b) by 181 days.

(21) Appl. No.: 13/785,018

(22) Filed: Mar. 5, 2013

(51) Int. Cl.
*A63B 21/015* (2006.01)
*A63B 21/02* (2006.01)

(52) U.S. Cl.
CPC ..... *A63B 21/023* (2013.01)

(58) Field of Classification Search
USPC ..... 482/127, 63–64, 115, 118, 119, 121, 482/92, 114, 117
See application file for complete search history.

(56) References Cited

U.S. PATENT DOCUMENTS

| | | | | |
|---|---|---|---|---|
| 766,743 | A | 8/1904 | Terry | |
| 913,799 | A | 3/1909 | Burguet | |
| 1,390,095 | A | 9/1921 | Dettinger | 607/78 |
| 1,573,362 | A | 2/1926 | Stovall | 482/148 |
| 1,954,762 | A | 3/1932 | Wolff | 482/127 |
| 2,951,702 | A | 5/1958 | Goodwin | 482/127 |
| 2,959,414 | A | 6/1958 | Saltz | 482/127 |
| 3,610,617 | A | 10/1971 | Hepburn | 482/116 |
| 3,841,627 | A | 10/1974 | Vetter | 482/110 |
| 3,885,789 | A | 5/1975 | Deluty | 482/120 |
| 4,174,832 | A | 11/1979 | Thompson | 482/120 |
| 4,328,965 | A | 5/1982 | Hatfield | 482/122 |
| 4,625,962 | A | 12/1986 | Street | 482/116 |
| 4,779,866 | A | 10/1988 | Marshall | 482/116 |
| 4,948,119 | A | 8/1990 | Robertson, Jr. | 482/56 |
| 5,195,937 | A | 3/1993 | Engel | 482/119 |
| 5,226,867 | A | 7/1993 | Beal | 482/127 |
| 5,292,293 | A | 3/1994 | Schumacher | 482/4 |
| 5,302,161 | A | 4/1994 | Loubert | 482/8 |
| 5,324,243 | A | 6/1994 | Wilkinson | 482/92 |
| 5,358,461 | A | 10/1994 | Bailey | 482/2 |
| 5,397,285 | A | 3/1995 | Haan et al. | 482/61 |
| 5,437,591 | A | 8/1995 | Chen | 482/127 |
| 5,486,149 | A | 1/1996 | Smith | 482/120 |
| 5,509,873 | A | 4/1996 | Corn | 482/74 |
| 5,618,249 | A | 4/1997 | Marshall | 482/127 |
| 5,709,637 | A | 1/1998 | Gow | 482/129 |
| 5,733,231 | A | 3/1998 | Corn | 482/120 |
| 5,755,646 | A | 5/1998 | Chu | 482/118 |
| 5,792,034 | A | 8/1998 | Kozlovsky | 482/124 |
| 5,876,310 | A | 3/1999 | Mackey | 482/74 |
| 6,099,447 | A | 8/2000 | Ramsaroop | 482/127 |
| 6,149,559 | A | 11/2000 | Mackey | 482/124 |
| 6,283,899 | B1 | 9/2001 | Charnitski | 482/110 |
| 6,315,701 | B1 | 11/2001 | Shifferaw | 482/114 |
| 6,544,152 | B2 | 4/2003 | Rosati | 482/126 |
| D487,123 | S * | 2/2004 | Ihli | D21/684 |
| 6,726,607 | B1 | 4/2004 | Ihli | 482/127 |
| 6,770,014 | B2 | 8/2004 | Amore | 482/92 |
| 7,087,001 | B1 * | 8/2006 | Ihli | 482/115 |
| 7,250,021 | B2 | 7/2007 | Leight | 482/116 |
| 7,322,909 | B1 | 1/2008 | Loccarini | 482/129 |

(Continued)

*Primary Examiner* — Loan H Thanh
*Assistant Examiner* — Megan Anderson

(57) ABSTRACT

An exercise apparatus includes a cable that is extracted from a housing when the extraction force is sufficient to rotate a drum that is rotatably mounted within the housing. A brake material is sandwiched between the drum and at least one tension band to provide adjustable resistance to rotation of the drum. A knob is rotated to adjust tension in the at least one tension band without affecting tension in the brake material. Indicia associated with rotation of the knob show changes in the resistance level as the knob rotates through more than one complete revolution relative to the housing.

20 Claims, 15 Drawing Sheets

(56) References Cited

U.S. PATENT DOCUMENTS

| | | | | |
|---|---|---|---|---|
| 8,556,783 | B1 * | 10/2013 | Ihli et al. | 482/115 |
| 2003/0153441 | A1 | 8/2003 | Berns | 482/128 |
| 2003/0211920 | A1 | 11/2003 | Mandel | 482/116 |
| 2006/0040805 | A1 | 2/2006 | Wilkinson | 482/124 |
| 2010/0137105 | A1 | 6/2010 | McLaughlin | 482/8 |

* cited by examiner

EXERCISE RESISTANCE APPARATUS

FIELD OF THE INVENTION

The present invention relates to exercise methods and apparatus, and more specifically, to the provision of selectively adjustable resistance to exercise motion.

BACKGROUND OF THE INVENTION

A variety of exercise devices have been developed to resist exercise motion. For example, U.S. Pat. No. 6,726,607 to Ihli and U.S. Pat. No. 7,087,001 to Ihli disclose exercise resistance devices that are compact and selectively adjustable. An object of the present invention is to provide improved exercise resistance devices that are compact and selectively adjustable.

SUMMARY OF THE INVENTION

The present invention involves exercise resistance devices having a drum rotatably mounted on a frame; at least one tension band disposed about at least a portion of the perimeter of the drum; a tension adjustment mechanism interconnected between the tension band(s) and the frame; and a force receiving member operatively connected to the drum in such a manner that movement of the force receiving member is linked to rotation of the drum.

One feature of the present invention is the provision of a braking strip disposed between the tension band(s) and the drum. The braking strip is preferably arranged so adjustments to the tension in the tension band(s) do not affect the tension in the braking strip. The braking strip preferably has one end secured to the drum and the other end resting on the perimeter of the drum. The braking strip is preferably a Kevlar™ strap.

Another feature of the present invention is the provision of diametrically opposed first and second tension bands. Each band preferably has a first end connected to the frame, and a second end connected to a respective nut. The nuts are preferably threaded onto respective ends of an adjustment bolt rotatably mounted on the frame. One nut and associated end of the bolt is reverse-threaded relative to the other nut and associated end of the bolt, and both nuts bear laterally against the frame. As a result, the nuts are constrained to move in opposite directions in response to rotation of the bolt.

Yet another feature of the present invention is the provision of a housing about the drum. In this regard, the frame preferably includes a bracket sandwiched between a front housing and a rear housing. The front housing and the rear housing preferably cooperate to define a shell that fits into a person's hand. A strap is preferably secured between protruding first and second portions of the bracket to extend across the back of the person's hand when the shell is held in the person's hand.

The foregoing features of the present invention may be practiced individually and/or in any combination with one another and/or with other features that will become apparent from the more detailed description that follows.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

In a certain respect, the present invention may be described in terms of improvements to the exercise apparatus disclosed in U.S. Pat. No. 6,726,607 to Ihli and U.S. Pat. No. 7,087,001 to Ihli, both of which are incorporated herein by reference to contribute to understanding of the construction, operation, and/or use of the present invention. As a result, the following description focuses primarily on distinctions between these prior art devices and the present invention, and takes into account the fact that shared attributes are already disclosed in the above-referenced patents. Nonetheless, the features of the present invention may also be implemented on or in connection with other types of exercise apparatus, as well.

Figure 1:
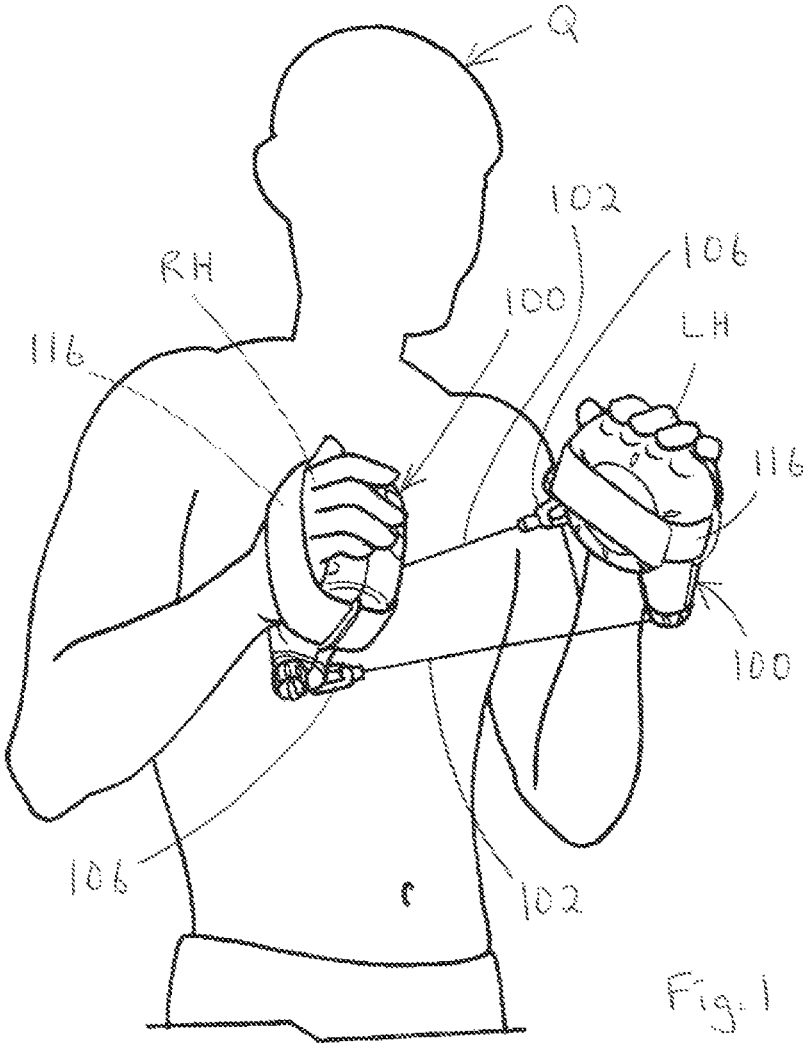
FIG. 1 is a diagrammatic view of a person exercising with two identical units of a preferred embodiment exercise apparatus constructed according to the principles of the present invention.

FIG. 1 shows an adult male Q exercising with two identical units 100 of an exercise apparatus constructed according to the principles of the present invention. One unit 100 fits into the palm of the person's left hand LH, and includes a strap 116 that wraps about the back of the person's left hand LH. The other unit fits into the palm of the person's right hand RH, and includes a strap 116 that wraps about the back of the person's left hand RH. The units 100 are shown connected to one another in a manner that accommodates various upper body exercises. In this regard, a cord 102 emanates from the left hand unit 100; a carabineer 106 is secured to the end of this cord 102; and this carabineer 106 is connected to an eyelet on the other, right hand unit 100. Similarly, a cord 102 emanates from the right hand unit 100; a carabineer 106 is secured to the end of this cord 102; and this carabineer 106 is connected to an eyelet on the other, left hand unit 100. This arrangement of the two units 100 is only one example of how the subject invention may be used for exercise purposes. For example, various force receiving members may be connected to the carabineer 106 on a unit 100, and/or a unit 100 may be supported by various elements other than a person's hand, including, for example, a body harness, a platform, a bench, a bed, or a post.

Various components of one of the units 100 are shown in FIGS. 2-14 (all of which are drawn to scale). Each unit or apparatus 100 preferably includes a frame comprising an injection molded front housing or shell half 120, an injection molded rear housing or shell half 140, and a stamped steel bracket 160 sandwiched between the housings 120 and 140. In this regard, five threaded inserts 114 (see FIG. 4) are secured in respective receptacles 144 in the rear housing 140 (see FIG. 8), and five screws 112 (see FIG. 3) are inserted through holes 122 in the front housing 120 (see FIG. 5), and through holes 162 in or past edges of the bracket 160 (see FIG. 12), and threaded into the inserts 114. FIG. 5 shows the front housing 120 by itself; FIG. 8 shows the rear housing 140 by itself; and FIG. 12 shows the bracket 160 by itself.

Figure 2:
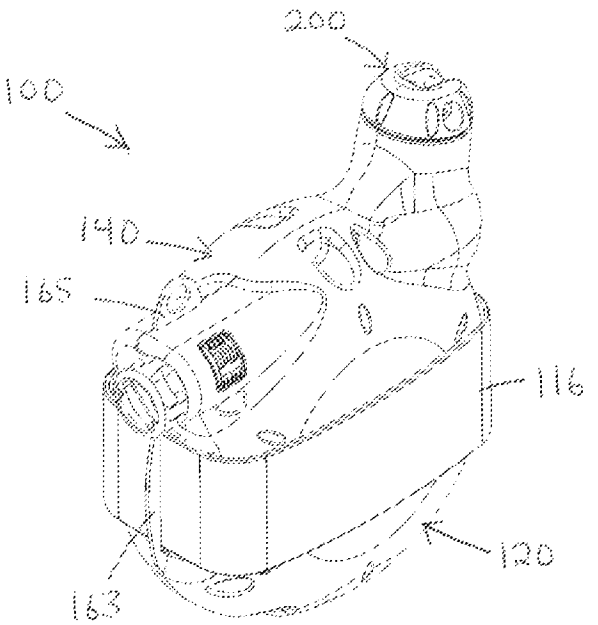
FIG. 2 is a perspective view of one of the exercise apparatus shown in FIG. 1, but without the cord or the carabineer.
Figure 3:
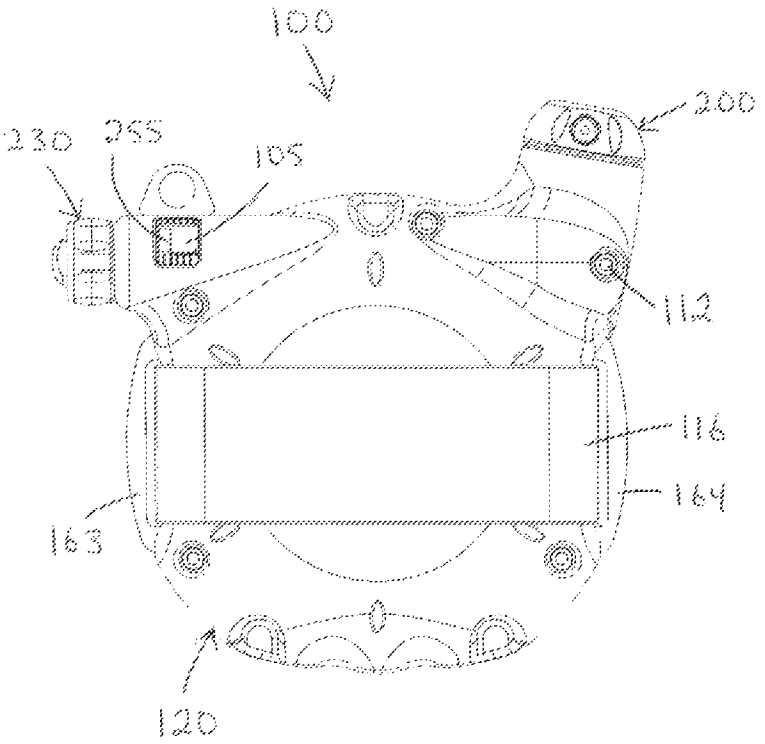
FIG. 3 is a side view of the exercise apparatus of FIG. 2.
Figure 4:
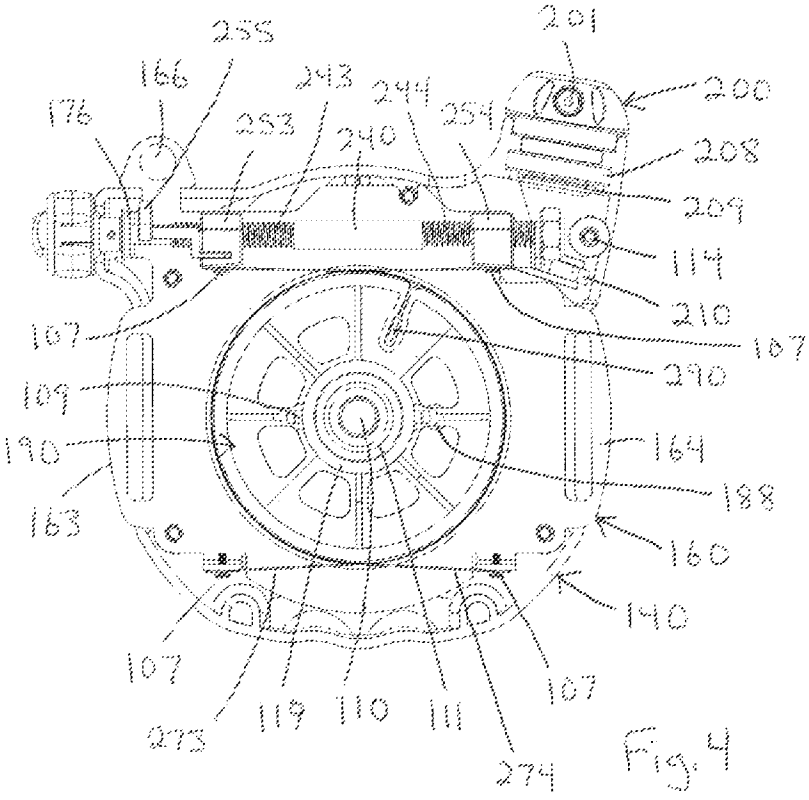
FIG. 4 is the same side view as FIG. 3, but with the near side of the exterior housing removed to illustrate the interior components.
Figure 5:
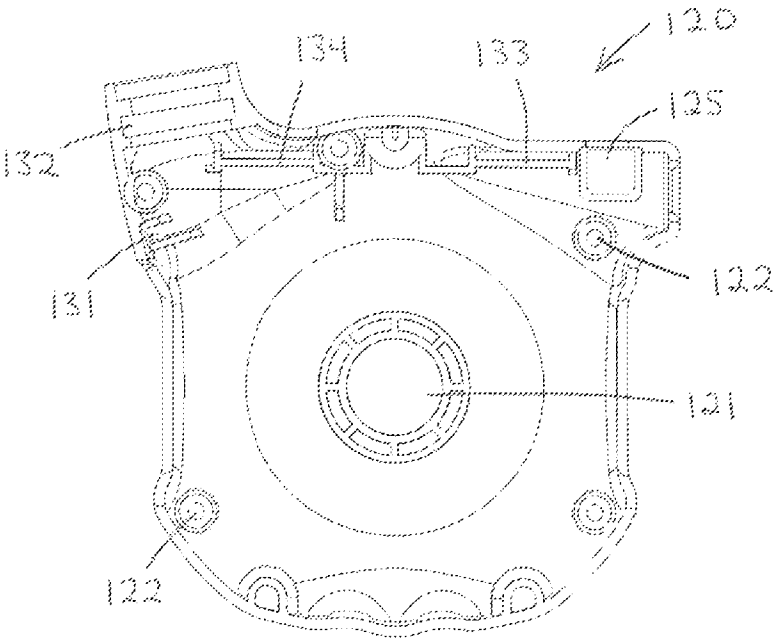
FIG. 5 is an opposite, inside view of the housing component shown in FIG. 3, and removed for FIG. 4.
Figure 6:
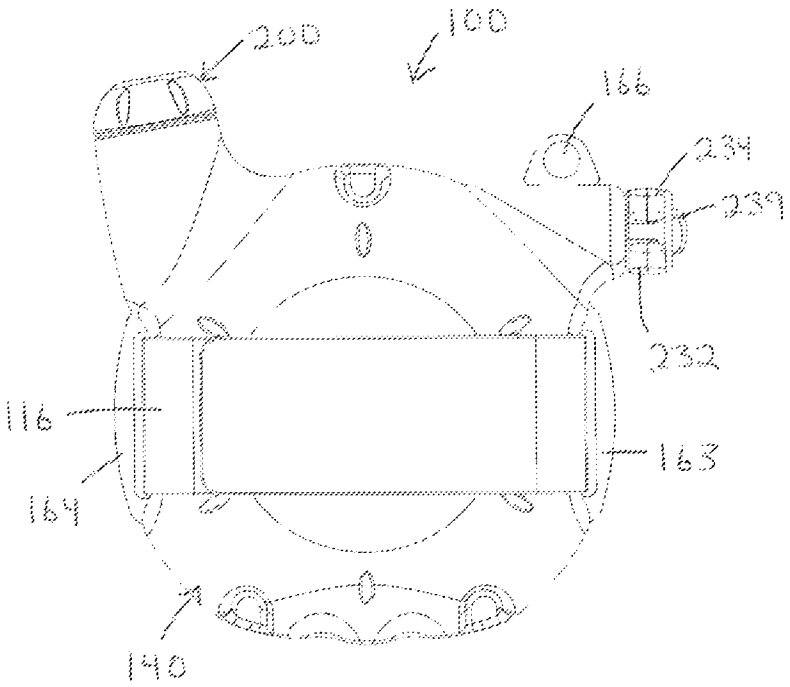
FIG. 6 is an opposite side view of the exercise apparatus of FIG. 2.
Figure 7:
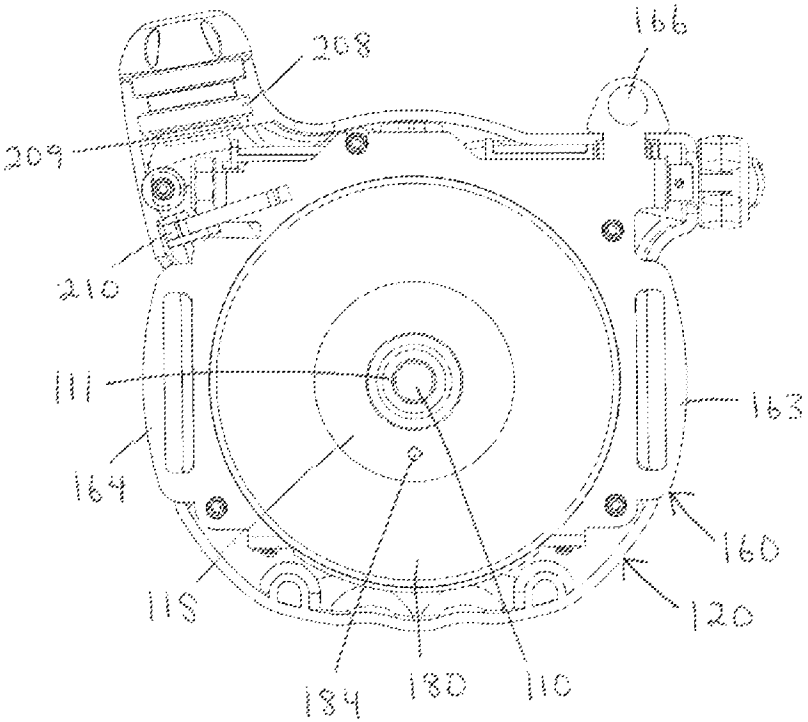
FIG. 7 is the same side view as FIG. 6, but with the near side of the exterior housing removed to illustrate the interior components.
Figure 8:
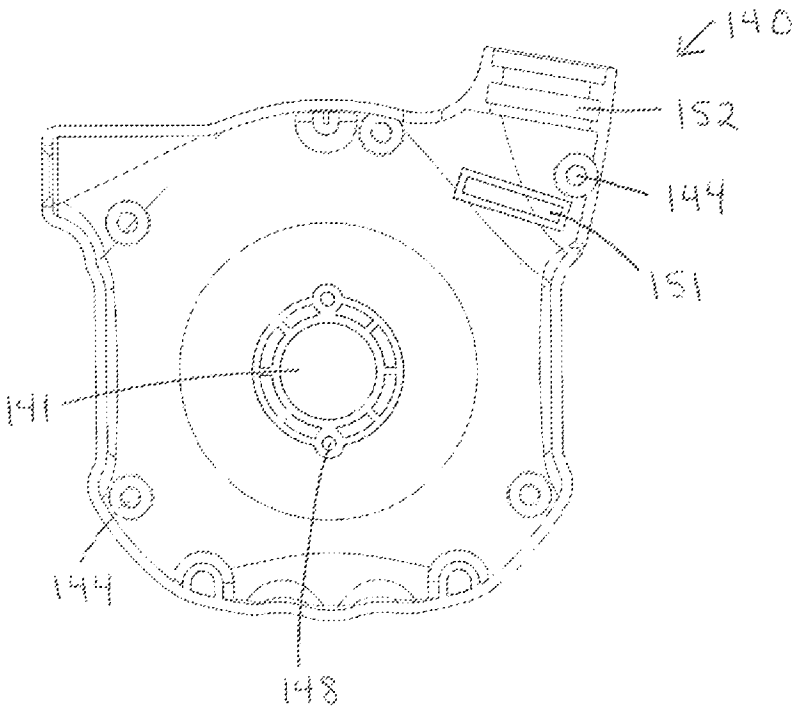
FIG. 8 is an opposite, inside view of the housing component shown in FIG. 6, and removed for FIG. 7.

As shown in FIGS. 4 and 7, the bracket 160 includes a first tab 163 that projects outwardly through a first gap defined between opposing edges of the front housing 120 and the rear housing 140, and a diametrically opposed, second tab 164 that projects outwardly through a second gap defined between opposing edges of the front housing 120 and the rear housing 140. As shown in FIG. 12, each tab 163 and 164 defines an identical slot 161 that is sized and configured to accommodate a section of the strap 116. As shown in FIGS. 2-3 and 6, the ends of the strap 116 are inserted through respective slots 161 and connected to one another in overlapping fashion by hook-and-loop type fasteners. The strap 116 is preferably made of woven Nylon material.

Figure 12:
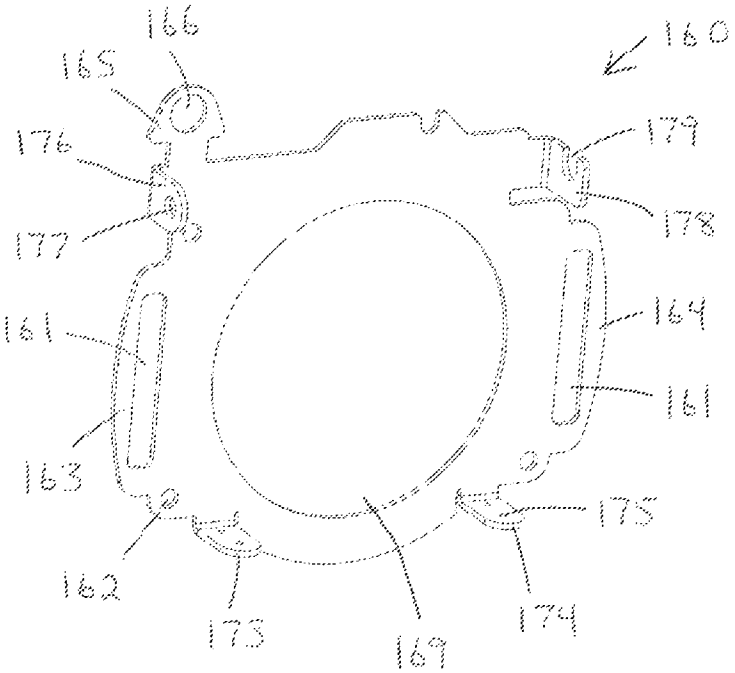
FIG. 12 is a perspective view of a bracket that is part of the exercise apparatus of FIG. 2.

FIG. 12 shows three holes 162 in the bracket 160, through which respective screws 112 are inserted, and a large central opening 169. FIG. 12 also shows a third tab 165 on the bracket 160, and the eyelet 166 that extends through the third tab 165. As shown in FIGS. 4 and 7, the third tab 165 projects outward through a third gap defined between opposing edges of the front housing 120 and the rear housing 140.

Figure 9:
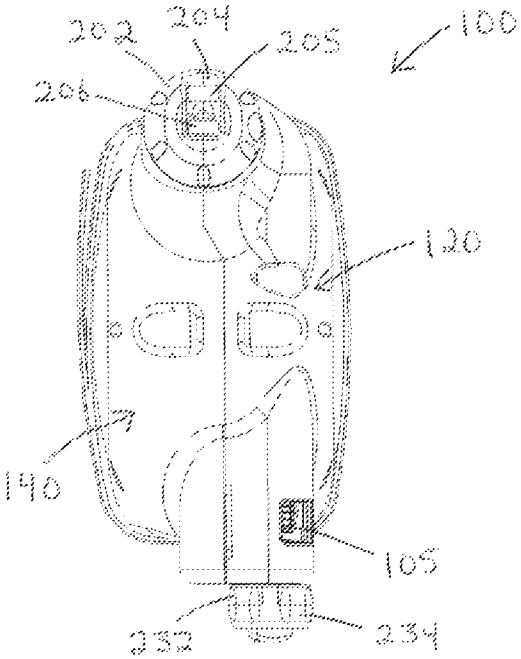
FIG. 9 is a top view of the exercise apparatus of FIG. 2.
Figure 10:
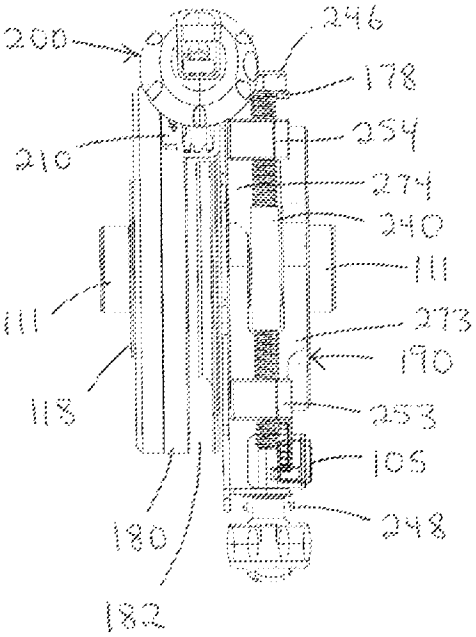
FIG. 10 is the same top view as FIG. 9, but with the front and rear housing components removed to illustrate the interior components.

As shown in FIG. 1, the cord 102 extends from the carabineer 106 into a re-directional bearing 200 rotatably retained between the housings 120 and 140. As shown in FIGS. 9-10, the re-directional bearing 200 includes a base 202 and a centrally located slot 204 extending through an upper forward portion of the base 202. For manufacturing purposes, the base 202 comprises two similar injection molded halves that are secured together by a threaded insert and a screw 201 (see FIGS. 3-4), and also by a commercially available C-clip 209 (see FIGS. 4 and 7). The re-directional bearing 200 also includes a commercially available bearing pack 208 that is mounted onto a bottom stem portion of the base 202 (prior to attachment of the C-clip 209). The front housing 120 includes a half-receptacle 132 (see FIG. 5) for the base 202 and the bearing pack 208, and the rear housing 140 similarly includes a half-receptacle 152 (see FIG. 8) for the base 202 and the bearing pack 208.

The slot 204 extends through a front portion of the base 202 and a top portion of the base 202. A first steel pin 205 is rotatably mounted to the base 202 and extends across a radially outward portion of the slot 204. A second steel pin 206 is rotatably mounted to the base 202 and extends across a radially inward portion of the slot 204. The cord 102 is routed downward between the two pins 205 and 206, and then downward through a forwardly eccentric bore extending through the base 202 (see FIGS. 9-10). The components of the re-directional bearing 200 cooperate to keep the cord 102 bearing against the forward pin 205 as the cord 102 is pulled anywhere in a hemispherical space centered about the rotational axis of the re-directional bearing 200 and bounded by a plane defined by the exposed interface between the base 202 and the housings 120 and 140.

Figure 14:
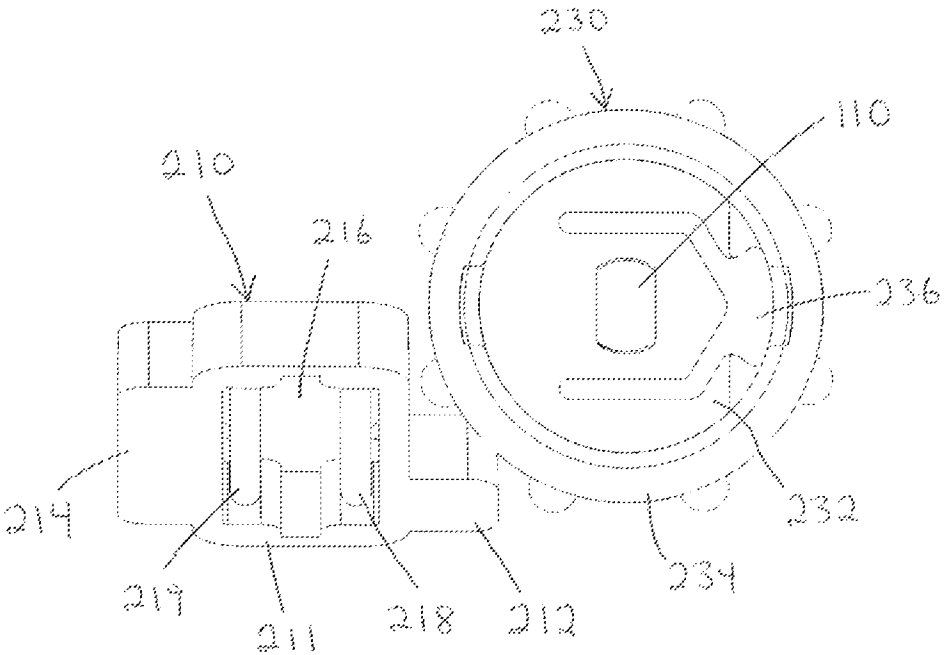
FIG. 14 is an end view of certain internal components of the exercise apparatus of FIG. 2.

The cord 102 extends from the bore in the re-directional bearing 200 to a cord guide 210, which is shown in FIG. 14 (together with components of a knob assembly described elsewhere). The cord guide 210 includes an injection molded base 211 having a first tab 212 that extends in a first direction, and a second tab 214 that extends in an opposite, second direction. A slot 216 extends through the base 211 between the tabs 212 and 214. A first steel pin 218 extends along one longer side of the slot 216, and is rotatably mounted on the base 211. Similarly, a second steel pin 219 extends along an opposite longer side of the slot 216, and is rotatably mounted on the base 211. As shown in FIGS. 5 and 7-8, the cord guide 210 is secured between the housings 120 and 140, with the first tab 212 inserted into a receptacle 131 in the front housing 120 (see FIG. 5), and the second tab 214 inserted into a receptacle 151 in the rear housing 140 (see FIG. 8). A portion of the base 211 adjacent the first tab 212 bears against the bracket 160. The cord 102 is routed downward between the pins 218 and 219 and then about a sheave 180. The pins 218 and 219 cooperate to keep the cord 102 from riding against respective sidewalls of the sheave 180 when the cord 102 is pulled in any plane that extends substantially perpendicular to the bracket 160, thereby rotating the bore out of alignment with the sheave 180.

Portions of the sheave 180 are shown in FIGS. 4, 7, and 10. The sheave 180 is functionally equivalent to the sheave disclosed in the above-referenced Ihli patents, so many of its features are not shown in detail in the accompanying Figures. The sheave 180 includes injection molded opposing sidewalls that define a groove 182 therebetween. The cord 102 has an inner end secured to the sheave 180 at the base of the groove 182, and the cord is wound about the base of the groove 182 and then itself.

A one-way clutch bearing is press-fit into the hub of the sheave 180, and a steel cylindrical shaft 110 is inserted through the one-way clutch bearing. The arrangement is such that the sheave 180 rotates together with the shaft 110 when the cord 102 is pulled from the sheave 180, and the sheave 180 rotates relative to the shaft 110 when the cord is wound back onto the sheave 180.

The sheave 180 includes an injection molded cylindrical cover that snaps into place on the outboard sidewall of the groove 182. The cover provides a housing for a concentrically wound, spring steel, recoil spring (not shown). A radially outer end of the spring is connected to the outboard sidewall of the groove 182. An opposite, radially inner end of the spring is connected to the rear housing 140 via a pin 184 (see FIG. 7) inserted into either of two holes 148 in the rear housing (see FIG. 8). As a result of this arrangement, the spring biases the cord 102 toward a retracted state within the housings 120 and 140, and wound about the sheave 180. In other words, the spring biases the sheave 180 to rotate in a rewind direction relative to the shaft 110, and resists rotation of the sheave 180 together with the shaft 110 when the cord 102 is pulled from the sheave 180.

As shown in FIG. 7, a first end of the shaft 110 inserts through a bearing pack 111, and a Teflon™ (or a Polytetrafluorethylene (PTFE)) washer 118 is disposed on the shaft 110 between the bearing pack 111 and the sheave 180. As shown in FIG. 8, the rear housing 140 includes a reinforced receptacle 141 for the bearing pack 111. Similarly, as shown in FIG. 4, an opposite, second end of the shaft 110 inserts through an identical bearing pack 111, and a Teflon™ washer 119 is disposed on the shaft 110 between the bearing pack 111 and a brake drum 190. As shown in FIG. 5, the front housing 120 includes a reinforced receptacle 121 for the bearing pack 111.

Figure 13:
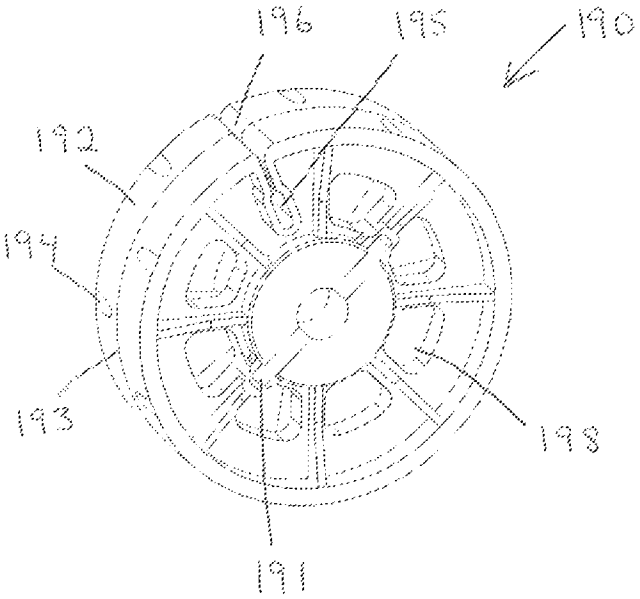
FIG. 13 is a perspective view of a brake drum that is part of the exercise apparatus of FIG. 2.

The injection molded brake drum 190 is shown by itself in FIG. 13. The brake drum 190 is keyed to the shaft 110 and thereby constrained to rotate together with the shaft 110. In this regard, a hole extends transversely through the shaft 110, and a pin 109 (see FIG. 4) is inserted through the hole in the shaft 110. As shown in FIG. 13, the brake drum 190 includes a slot 191 to receive the pin 109 when the pin 109 is pushed half-way through the hole in the shaft 110.

The brake drum 190 defines a circumferential perimeter or bearing surface 192. A circular parting line 193 is centrally located about the bearing surface 192, and the bearing surface 192 angles in opposite directions away from the parting line 193, thereby giving the bearing surface 192 a slightly inverted V-shaped profile. Staggered divots or notches 194 extend into respective lateral edges of the bearing surface 192 at circumferentially spaced locations about the bearing surface 192. The notches 194 and/or the centerline 193 may be described as at least one centering feature that encourages a braking strip 290 to remain centered on the perimeter 192 of the drum 190. A texture pattern may also be applied to the bearing surface 192 to define such a centering feature. The braking strip 290 (see FIG. 4) is preferably a Kevlar™ (or a para-aramid synthetic fiber) strap having a first end that is folded against itself and sewn into a doubly thick end, and a second end that is terminated in a manner that discourages fraying.

A radially extending slot 195 interrupts the perimeter 192 of the drum 190 and receives the doubly thick end of the braking strip 290. One sidewall of the slot 195 defines a right angle corner with the perimeter 192 of the drum 190, while the opposite sidewall of the slot 195 forms a filleted or rounded juncture 196 with the perimeter 192 of the drum 190. The slot 195 is slightly thinner than the braking strip 290 at its radially outward end, and at least twice as wide at its radially inward end. Also, laterally extending ridges extend along the sidewalls bordering the radially outward end of the slot. The doubly thick end of the braking strip 290 is inserted into the radially inward end of the slot 195, and the adjacent thinner portion of the braking strip 290 is inserted into the radially outward end of the slot 195. The subsequent adjacent portion of the braking strip 290 is wrapped about the rounded corner 196 and then around the perimeter 192 of the drum 190. The length of the braking strip 290 is such that the free end may be pulled to the right angle corner of the slot 195, but not into contact with the portion of the braking strip 290 emanating from the slot 195. As a result of this arrangement, the rounded corner 196 pulls the wrapped portion of the braking strip 290 through circles in response to withdrawal of the cord 102 from the sheave 180.

For strength and manufacturing efficiency, the drum 190 is cored to an extent, and holes 198 extend through an intermediate section of the drum 190. The holes 198 align with a cord 102 tie-off point associated with the sheave 180, thereby providing access for replacing the cord 102 with a new cord 102, if and when needed.

As shown in FIG. 4, a first tension band 273 is secured in a generally U-shaped configuration about one half of the braking strip 290 and underlying perimeter 192 of the drum 190, and a second tension band 274 is secured in a generally U-shaped configuration about an opposite half of the braking strip 290 and underlying perimeter 192 of the drum 190. Each tension band 273 and 274 is preferably a strip of stainless spring steel that is formed into a stable U-shaped configuration prior to installation on the unit 100.

A first end of the first tension band 273 is anchored to a fourth tab 173 on the bracket 160 (see FIG. 12). Similarly, a first end of the second tension band 274 is anchored to an identical fifth tab 174 on the bracket 160 (see FIG. 12). In this regard, first and second holes 175 extend through each tab 173 or 174, and comparable holes extend through the first end of each tension band 273 and 274, and pairs of first and second screws 107 (see FIG. 4) insert through respective tension bands 273 and 274 and thread into respective holes 175. An opposite, second end of the first tension band 273 is anchored to a first steel adjustment nut 253 by means of comparable holes in the nut 273 and the second end of the first tension band 273, and identical first and second screws 107. Similarly, an opposite, second end of the second tension band 274 is anchored to a second steel adjustment nut 254 by means of comparable holes in the nut 274 and the second end of the second tension band 274, and identical first and second screws 107.

The first nut 253 is threaded onto RH threads 243 on a first end of an adjustment bolt 240. The second nut 254 is threaded onto LH threads 244 on an opposite, second end of the adjustment bolt 240. Each nut 253 and 254 has a flat side that bears against a respective flat portion of the bracket 160.

The adjustment bolt 240 is rotatably mounted on the bracket 160. In this regard, as shown in FIGS. 4 and 12, the first end of the adjustment bolt 240 is inserted through a hole 177 in a sixth tab 176 on the bracket 160, and an opposite, second end of the adjustment bolt 240 is dropped into a slot 179 in a seventh tab on the bracket. As shown in FIG. 5, rails 133 and 134 on the front housing 120 are configured and arranged to bear against the tops of respective nuts 253 and 254 to prevent the adjustment bolt 240 from rising out of the slot 179. Also, stops are provided at the ends of the rails 133 and 134 to limit axial travel of the nuts 253 and 254 along the adjustment bolt 240.

Figure 11:
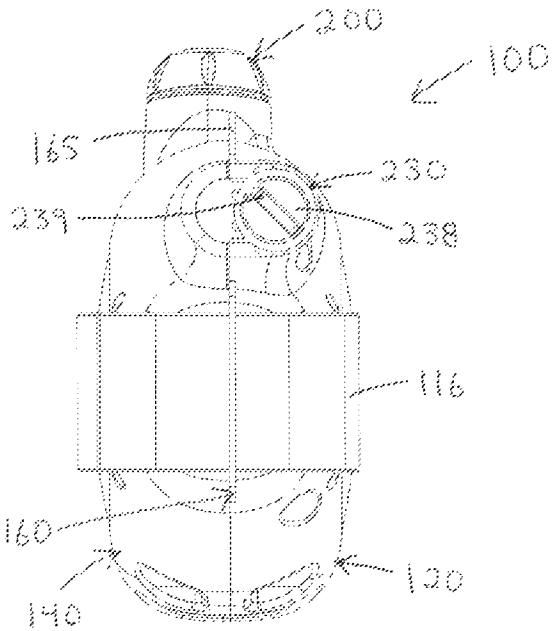
FIG. 11 is an end view of the exercise apparatus of FIG. 2.

A steel and nylon lock nut 246 is threaded onto the second end of the bolt 240, with a Teflon™ (or a Polytetrafluorethylene (PTFE)) washer disposed on the second end of the bolt between the lock nut 246 and the seventh tab 178 on the bracket 160. A knob 230 is keyed (see FIG. 14) and pinned (see pin 248 in FIG. 10) to the first end of the bolt 240, with a Teflon™ washer disposed on the first end of the bolt 240 between the knob 230 and the sixth tab 176 on the bracket 160. The knob 230 and the lock nut 246 cooperate to prevent axial movement of the bolt 240 relative to the bracket 160. The arrangement of the nuts 253 and 254 and the bolt 240 is such that the nuts 253 and 254 move away from one another when the bolt 240 is rotated in a first direction, and move toward one another when the bolt 240 is rotated in an opposite, second direction. In other words, from the perspective of a person facing the unit 100 as shown in FIG. 11, rotation of the knob 230 in a clockwise direction causes the nuts 253 and 254 to move away from one another, thereby increasing resistance to rotation of the drum 190, and rotation of the knob 230 in a counter-clockwise direction causes the nuts 253 and 254 to move toward one another, thereby decreasing resistance to rotation of the drum 190.

The knob 230 is an assembly of four injection molded parts. As shown in FIGS. 6, 11, and 14, the knob 230 includes a base 232 that is keyed to the shaft 110, and pinned to the shaft 110 by pin 248. A two-pronged latch 236 is keyed to the base 232 with the prongs straddling the shaft 110. A dial 238 has a neck portion (not shown) that is rotatably mounted on the end of the shaft 110 (via a cylindrical bore in the neck portion), and that has an octagonal outer profile with opposing sides sized and configured to fit snugly between the prongs of the latch 236. The prongs are leaf springs that discourage rotation of the dial 238, but resiliently deflect to accommodate rotation of the dial 238 relative to the shaft 110 (and the base 232). A cap 234 snaps onto the base 232 to capture the dial 238 and the leaf spring 236, and is keyed to the base 232 for rotation together therewith. A fin on the dial 238 extends in a direction opposite the neck portion to accommodate grasping of the dial 238 between a person's thumb and forefinger. A nub 239 on one end of the fin provides a visual indication of the orientation of the knob 230 and the shaft 110. The dial 238 is selectively rotated relative to the knob 230 and the shaft 110 to recalibrate the orientation of the nub 239 as an indication of relative resistance to rotation of the drum 190 (in increments of 45 degrees).

As shown in FIG. 4, an injection molded indicator finger or pointer 255 is rigidly secured to the adjustment nut 253 by means of one of the screws 107 (and a slot in the nut 253). As a result, the pointer 255 travels linearly together with the nut 253. As shown in FIG. 3, the finger 255 is visible through an injection molded window 105 mounted on the front housing 120 (via adhesive or other known suitable means). FIG. 5 shows a receptacle 125 for the window 105 in the front housing 120. The window 105 includes staggered and alternating hash marks along its upper and lower visible edges. The position of the finger 255 relative to the hash marks on the window 105 indicates a relative range of resistance associated with a revolutionary increment of the knob 230. In other words, the location of the finger 255 provides a macro reading of relative resistance, and the orientation of the indicator 239 provides a micro reading of relative resistance. Each time the knob 230 goes through a revolution, the indicator 239 returns to the same orientation, but the finger 255 moves to a different position relative to the hash marks on the window 105. The adjustability of the dial 238 allows one unit 100 to be calibrated relative to another unit 100 with regard to the micro reading of relative resistance.

Figure 15:
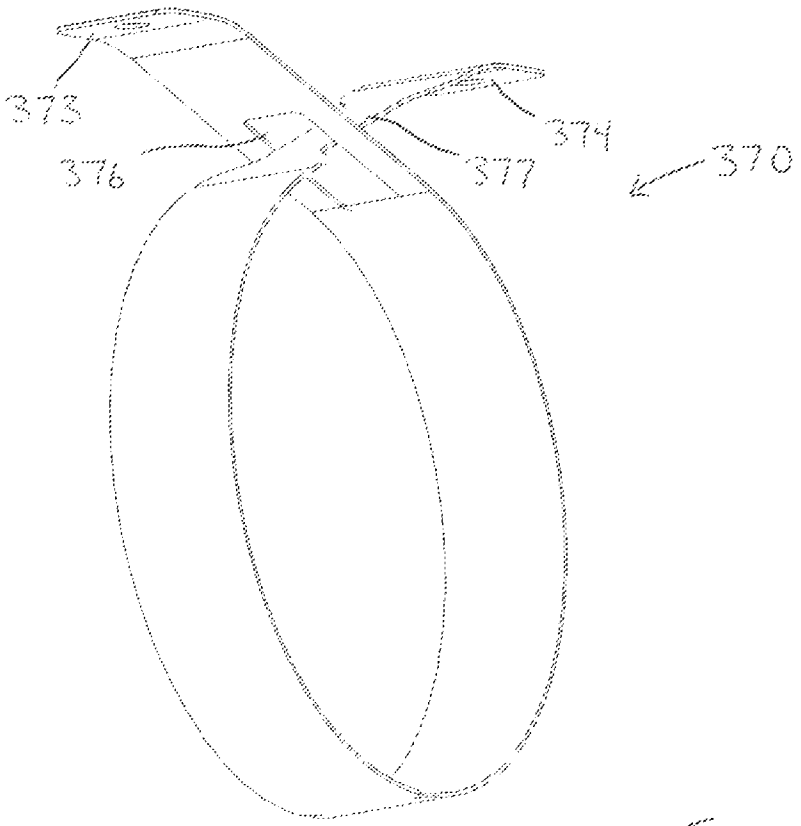
FIG. 15 is a perspective view of an alternative embodiment brake band that may be substituted onto the exercise apparatus of FIG. 2.

FIG. 15 shows an alternative embodiment tension band 370 that is substituted for the tension bands 273 and 274 on an alternative embodiment of the present invention. The tension band 370 has a first end 373 that is screwed to the adjustment nut 253, and an opposite, second end 374 that is screwed to the adjustment nut 254. A slot 376 extends through a first portion of the tension band 370, proximate the first end 373. A portion 377 of the tension band 370, proximate the second end 374, is necked down or narrowed to pass through the slot 376 with minimal clearance. The slot 376 and the narrowed portion 377 allow the tension band 370 to be arranged into a closed loop, in the same general way that the tension bands 273 and 274 are interlaced.

The subject invention has been described with reference to a preferred embodiment with the understanding that features of the subject invention may be practiced individually and/or in various combinations and/or on various types of exercise equipment. Also, persons skilled in the art will recognize that various modifications may be made to the preferred embodiment, in any of its applications, without departing from the scope of the subject invention. Furthermore, alternative embodiments may be made with different component materials, structures, and/or spatial relationships, and nonetheless fall within the scope of the present invention. In view of the foregoing, the subject invention should be limited only to the extent of the claims set forth below.

What is claimed is:

1. An exercise apparatus, comprising:

a frame;

a drum rotatably mounted on the frame for rotation about an axis, wherein the drum defines a circumferential perimeter;

at least one tension band disposed about at least a portion of the perimeter of the drum;

a braking strip disposed between the tension band and the drum, wherein a first end of the braking strip is secured to the drum, and an opposite, second end of the braking strip rests on the circumferential perimeter of the drum;

a tension adjustment mechanism interconnected between said at least one tension band and the frame, and operable to adjust tension in said at least one tension band; and a force receiving member operatively connected to the drum, wherein movement of the force receiving member is linked to rotation of the drum.

2. The exercise apparatus of claim 1, wherein the braking strip comprises a para-aramid synthetic fiber strap.

3. The exercise apparatus of claim 2, wherein said at least one tension band comprises at least one steel strap.

4. The exercise apparatus of claim 3, wherein the drum comprises at least one injection molded plastic part, and defines a radially extending slot that interrupts the perimeter of the drum and receives the first end of the para-aramid synthetic fiber strap.

5. The exercise apparatus of claim 1, wherein the perimeter of the drum defines at least one centering feature that encourages the second end of the braking strip to remain centered on the perimeter of the drum.

6. An exercise apparatus, comprising:

a frame, wherein the frame includes a bracket sandwiched between a front housing and a rear housing;

a drum rotatably mounted on the frame for rotation about an axis, wherein the drum defines a circumferential perimeter between the bracket and the front housing;

at least one tension band disposed about the perimeter of the drum;

a tension adjustment mechanism interconnected between said at least one tension band and the bracket, and operable to adjust tension in said at least one tension band; and a force receiving member operatively connected to the drum, wherein movement of the force receiving member is linked to rotation of the drum.

7. The exercise apparatus of claim 6, further comprising a sheave rotatably mounted on the frame for rotation about the axis, wherein the sheave is disposed between the bracket and the rear housing, and a flexible cord is interconnected between the sheave and the force receiving member.

8. The exercise apparatus of claim 7, wherein a central hole extends through the bracket, and the hole is relatively larger in diameter than the drum, and at least one bushing is disposed between the drum and the sheave.

9. The exercise apparatus of claim 6, further comprising a strap secured across an exterior side of at least one said housing, wherein the strap and the exterior side cooperate to form a closed loop about a person's hand when the exterior side is positioned in a person's hand.

10. The exercise apparatus of claim 9, wherein the bracket includes a first tab that projects outwardly through a first gap between the front housing and the rear housing, and a diametrically opposed, second tab that projects outwardly through a second gap between the front housing and the rear housing, and the strap is interconnected between the first tab and the second tab.

11. An exercise apparatus, comprising:

a frame;

a drum rotatably mounted on the frame for rotation about an axis, wherein the drum defines a circumferential perimeter;

at least one tension band disposed about at least a portion of the perimeter of the drum;

a tension adjustment mechanism interconnected between said at least one tension band and the frame, and operable to adjust tension in said at least one tension band, wherein the tension adjustment mechanism includes a bolt rotatably mounted on the frame, and a first portion of the bolt is threaded with right hand threads, and a second portion of the bolt is threaded with left hand threads, and a first nut is threaded onto the first portion of the bolt, bears against a first flat surface on the frame, and is fastened to a first end of said at least one tension band, and a second nut is threaded onto the second portion of the bolt, bears against a second flat surface on the frame, and is fastened to a second end of said at least one tension band, whereby rotation of the bolt in a first direction causes the first nut and the second nut to move toward one another, thereby reducing tension in said at least one tension band, and rotation of the bolt in an opposite, second direction causes the first nut and the second nut to move away from one another, thereby increasing tension in said at least one tension band; and a force receiving member operatively connected to the drum, wherein movement of the force receiving member is linked to rotation of the drum.

12. The exercise apparatus of claim 11, wherein said at least one tension band is a single tension band arranged to form a closed loop about the drum.

13. The exercise apparatus of claim 12, wherein a first portion of the single tension band has a reduced width, and a second portion of the single tension band defines a slot, and the reduced width inserts through the slot to form the closed loop about the drum.

14. The exercise apparatus of claim 11, wherein said at least one tension band includes a first tension band and a diametrically opposed, second tension band arranged to form a closed loop about the drum.

15. The exercise apparatus of claim 14, wherein a first portion of the first tension band has a reduced width, and a second portion of the first tension band defines a slot, and a first portion of the second tension band has a reduced width, and a second portion of the second tension band defines a slot, and the reduced width of the first tension band inserts through the slot in the second tension band, and the reduced width of the second tension band inserts through the slot in the first tension band, to form the closed loop about the drum.

16. The exercise apparatus of claim 14, wherein an end of the first tension band opposite said first end is fastened to the frame, and an end of the second tension band opposite said second end is fastened to the frame.

17. The exercise apparatus of claim 16, wherein at least one said end of each said tension band is fastened in place by two screws.

18. The exercise apparatus of claim 11, wherein linear travel of at least one said nut is monitored relative to the frame to indicate a relative level of current resistance to rotation of the drum.

19. The exercise apparatus of claim 18, wherein a knob is connected to the bolt, and rotation of the knob is monitored relative to the frame to indicate a relative level of current resistance to rotation of the drum.

20. The exercise apparatus of claim 19, wherein an indicator is movably mounted on the knob and selectively reoriented relative to the knob to recalibrate the relative level of resistance indicated by orientation of the knob relative to the frame.

* * * * *